United States Patent [19]

Ginex et al.

[11] 4,037,510

[45] July 26, 1977

[54] FRET REFINISHING APPARATUS AND METHOD

[76] Inventors: Michael F. Ginex, 119-59 27th Ave., New York, N.Y. 11354; Donald E. Thomas, 143-57 Rose Ave., New York, N.Y. 11355

[21] Appl. No.: 667,900

[22] Filed: Mar. 17, 1976

[51] Int. Cl.[2] ..... G10G 7/00; G10D 3/06; B24D 15/00

[52] U.S. Cl. ..... 84/453; 51/204; 84/314; 84/458

[58] Field of Search ..... 84/458, 453, 267, 297, 84/314; 51/204; 29/78

[56] References Cited

U.S. PATENT DOCUMENTS

| | | | |
|---|---|---|---|
| 643,159 | 2/1900 | Rapp | 84/297 R |
| 1,253,550 | 1/1918 | Wilkins | 84/297 R |
| 1,520,488 | 12/1924 | Tone | 51/204 |
| 2,315,749 | 4/1943 | Tubbs | 51/204 |
| 2,386,900 | 10/1945 | Kingman | 51/204 |

*Primary Examiner*—Stephen J. Tomsky
*Attorney, Agent, or Firm*—Ernest F. Marmorek

[57] ABSTRACT

An apparatus and method for refinishing fingerboard frets of a fretted stringed instrument.

12 Claims, 12 Drawing Figures

NEW GUITAR FRET

PRIOR ART REFINISHING

PRESENT INVENTION REFINISHING

FRET REFINISHING APPARATUS AND METHOD

BACKGROUND OF THE INVENTION

The invention relates to an apparatus and method for refinishing the fingerboard frets of a fretted stringed instrument.

The invention relates more particularly to a method and apparatus which may be used for leveling the frets of a fretted stringed instrument and thereafter properly peaking or polishing the frets, with the removal of any burrs formed in the leveling procedure.

Refinishing, reconditioning, reshaping, dressing or truing the frets of a fretted stringed instrument, have heretofore normally required:

1. removal of the strings from above the fingerboard, either by removal from the instrument or by stretching the strings apart;

2. leveling or dressing the frets to extend about the same height above the fingerboard, usually be filing or sanding, whereby any grooves which may have been formed by wearing against the strings, are removed; and 3. peaking or polishing and removal by filing or sanding of any burrs that may have formed on the fret, usually by cutting the longitudinal edges at an angle at the top.

This or similar refinishing techniques have been described in a number of manuals or books, of which reference is had especially to:

1. Mc Leod and Welford, "The Classical Guitar Design and Construction", The Dryad Press, Woodridge, New Jersey, page 16 describing a block file; and page 90 describing the shaping of a fret.

2. Sloane, "Guitar Repair", E. P. Dutton and Co., Inc., New York (1973), pages 41–42 describe a technique for rounding the frets.

3. Staff of Guitar Player Magazine, "Guitar Repair Manual", Oak Publications, New York, page 13 describes fret leveling and shaping.

4. Teeter, "The Acoustic Guitar, Adjustment, Care, Maintenance and Repair", University of Oklahoma Press, (1975) pages 109, 110 and 106, describe refinishing of frets.

These describe essentially the methods used either by do-it-yourself fret refinishers or by professional fret refinishers. It should be noted that the strings have been removed and no mention of "relief" is made. Often, even professional fret refinishers do not take into account the fingerboard relief resulting from the proper tuning and design of the guitar. Some profession techniques are guarded secrets and not generally known.

The relief, as is known in the art, is the slight bowing or bending of the fingerboard which helps avoid buzzing caused by the low clearance between the strings and frets over which the string must pass. The removal of the strings from the instrument tension on the fingerboard and the amount of relief therefore becomes less. Thus the top surfaces of the frets are slightly differently aligned with respect to each other when the strings have been released as compared to when the instrument is properly tuned and under tension as a result of the taut strings.

Additionally, usual prior art methods of refinishing frets do not result in a properly shaped fret. To illustrate this, reference is had to FIG. 1A which shows a side view of a fingerboard 1 with a properly shaped fret 12 embedded therein. A string 13 of the stringed instrument will be tangent to the center portion of the fret, when pressed against the fret as shown. FIG. 1B, similar to FIG. 1A, shows a fret **12*a* leveled below any groove or wear mark formed in the fret 12 by the string 13, using the prior art method. It can be seen especially that the string 13, when pressed against the fret 12*a* does not leave the surface of the fret 12*a*** until near the edge. This results in a slightly shorter effective string length and therefore a slightly sharper note.

FIG. 1C shows a fret peaked or polished according to the usual prior art method described above. It can be seen that the fret **12*b* still does not have the shape of a fret 12 which the manufacturer intended. The string is not tangent to the center of the fret 12*b* but rather extends across a slight area on the top of the fret 12*b* thus resulting in a slightly sharper note similar to but not as pronounced an effect which would be obtained with a fret 12*a* as shown in FIG. 1B**.

Additionally the effect of relaxing the relief of the fingerboard by removal of the strings would be such as to make the frets non-symmetrical or misaligned with respect to each other and the instrument when the relief is once more attained by replacing the strings. The result of this condition of non-symmetry and misalignment during the leveling procedure may be incorrect clearances causing interferences of the vibrating string and those frets immediately adjacent to the fret being played. This interference is objectionable in as much as it creates a buzzing or rattling sound.

It is to be noted that many professional fret refinishers will allow for the relief of the fingerboard when refinishing the frets, but a properly shaped fret is not always obtained and the fees charged by professional refinishers are often considerable. Instructions for the refinishing of frets by non-professional fret refinishers, that is the usual stringed instrument player, do not take into account the relief of the fingerboard and usually result in a fret with the shape **12*b* shown in FIG. 1C**.

SUMMARY OF THE INVENTION

One of the principal objects of the invention is to provide a method and apparatus for properly refinishing the frets on a fretted stringed instrument. Additional objects of the invention include proper refinishing of a fret without the removal of the strings and while substantially maintaining the proper relief in the fingerboard of the instrument.

Further objects and advantages of the invention will be set forth in part in the following specification and in part will be obvious therefrom without being specifically referred to, the same being realized and attained as pointed out in the claims hereof.

Other objects of the invention will in part be obvious and will in part appear hereinafter.

With the above and other objects of the invention in view, the invention consists in the novel method, construction, arrangement and combination of various devices, elements and parts, as set forth in the claims hereof certain embodiments of the same being illustrated in the accompanying drawings and described in the specification.

The invention accordingly comprises the features of construction, combination of elements and arrangement of parts which will be exemplified in a construction hereinafter set forth; and in the several steps and relation of one or more of such steps with respect to each of the others, all as exemplified in the following detailed disclosure, and the scope of the application which will be indicated in the claims.

DESCRIPTION OF THE PREFERRED EMBODIMENTS

Figure 2:
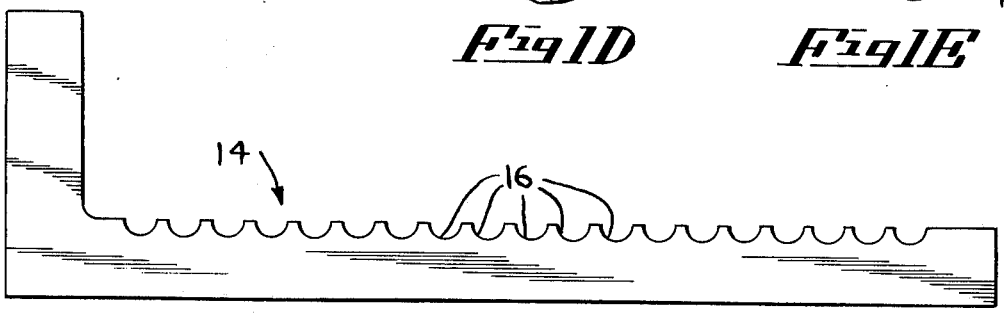
FIG. 2 is an elevational side view of an L-Shaped string lifting device according to the instant invention.
Figure 3:
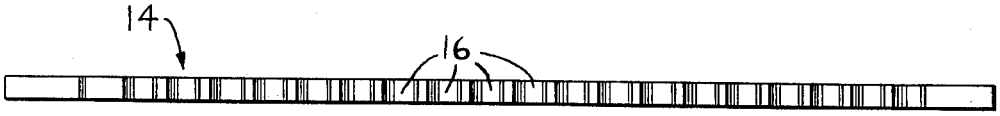
FIG. 3 is a top plan view of the string lifting device as shown in FIG. 2.

In carrying the invention into effect in the embodiments which have been selected for illustration in the accompanying drawings and for description in the specification, and referring now particularly to FIGS. 2 and 3, an L-shaped tool or string lifting device 14 is shown that serves to lift the strings 13. The L-shaped tool 14 may have grooves 16 that are formed in its upper elongated edge for receiving the strings 13 of a fretted stringed instrument, such as the guitar 17 shown in FIG. 8. FIGS. 4–7 show a flat tool **18, 18*a*. The flat tool 18 is composed of a plate which has flat surface portions 19, 19*a* on one side and a surface 21 having raised elongated portions 22, 22*a*. The elongated portions 22, 22*a* appear as elongated grooves 23 (23*a*, FIG. 7) in the flat surface portion 19**.

Figure 4:
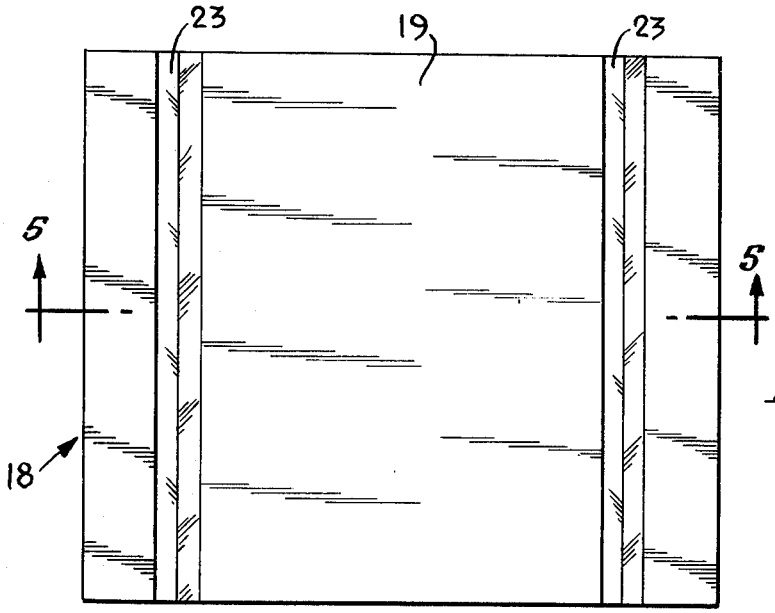
FIG. 4 is a top plan view of a flat tool fret shaping device according to the instant invention.
Figure 5:
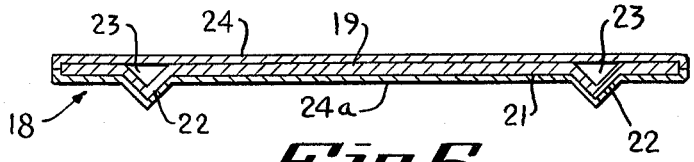
FIG. 5 is a sectional view of the fret shaping device taken on the line 4–4 of FIG. 4.
Figure 6:
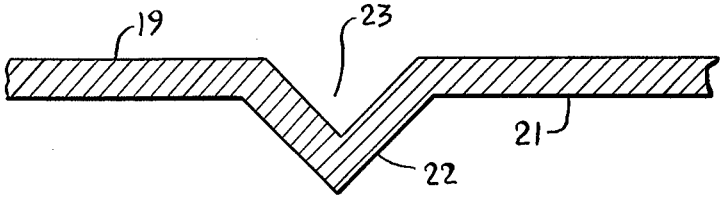
FIG. 6 is a large scale fragmentary sectional view showing a detail of the fret shaping device shown in FIG. 5.
Figure 7:
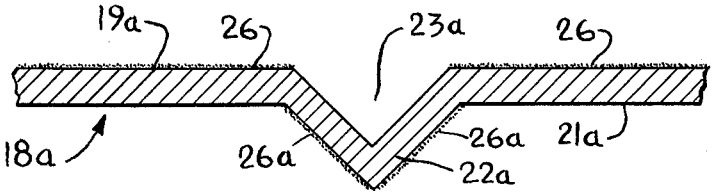
FIG. 7 is a view similar to FIG. 6 but shows a modification wherein abrasive material is embedded in the surface of the fret shaping device.

For the embodiment shown in FIGS. 4, 5 and 6, a piece of flexible abrasive material such, for example emery cloth 24 or **24*a*, as shown in FIG. 5 is supported thereon. The modification shown in FIG. 7 has abrasive material, such as diamond dust 26, embedded in the surface 19*a*, 21*a*, or secured later on. It is the raised portion 22*a*, on the surface 21*a*, as shown in FIG. 7, which receives the abrasive material 26. It is preferable not to have abrasive material on the very peak of the raised surface 22*a*, to retard abrasive action on the fingerboard 11**, as will be discussed below.

Figure 8:
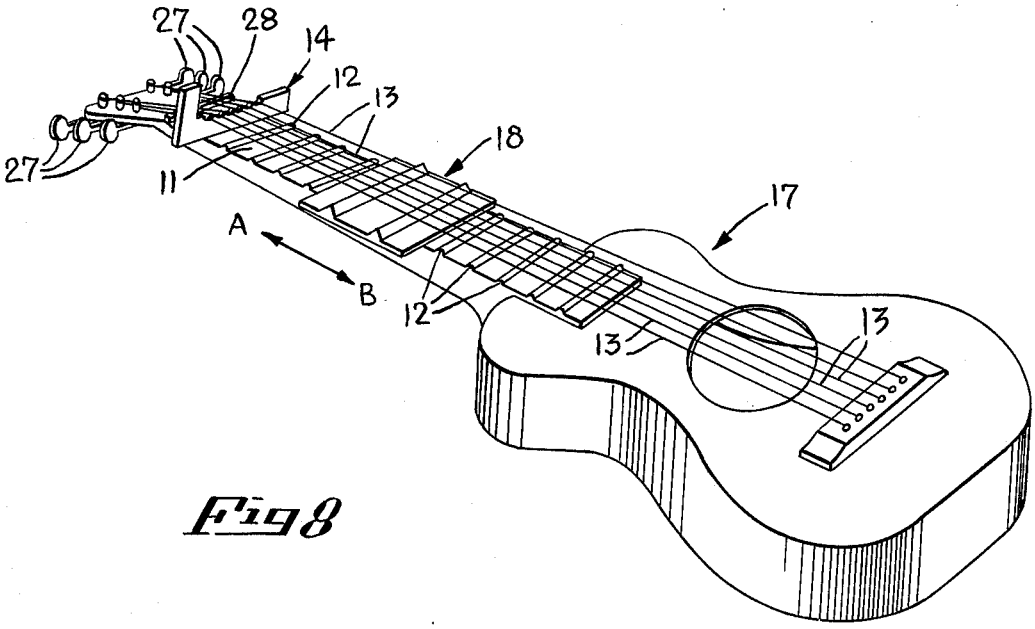
FIG. 8 is a perspective view of a guitar showing the apparatus of the instant invention, operably in place.

The FIG. 8 shows a guitar 17, although the instant invention will work with any similar fretted stringed instrument. The L-shaped tool or string lifting device 14 and the flat tool 18 are shown operably in place. The tool 18 is moved back and forth in the direction of double arrow A-B, during use.

OPERATION

The operation of the above described embodiments of the invention is as follows:

With reference to the guitar 17 as shown in FIG. 8, the strings 13 are first loosened, normally by turning each peg 27 until the strings 13 are sufficiently loose.

A string lift device such as the L-shaped tool 14 is inserted between the fingerboard 11 and the strings 13, by turning the L-shaped tool 14 so that the L-form is in the plane of the fingerboard 11 and can easily slip between the strings 13 and the fingerboard 11. The L-shaped tool 14 is then turned approximately 90° as shown in FIG. 8, thereby lifting the strings 13 away from the fret 12. In the preferred embodiment, there are grooves or slots 16 formed in part of the string lifting device or L-shaped tool 14, as shown in FIG. 2. The strings 13 are carried in the grooves 16.

It is advantageous to provide some sort of protective barrier between the L-shaped tool 14 and the fingerboard 11 to prevent the tool 14 from scratching the surface of the fingerboard 11. A protective strip of cloth or other suitable material may be used (not shown). In the preferred use of the string lifting device such as the L-shaped tool 14, it is inserted near the nut 28 of the string instrument or guitar 17, between the nut 28 and the first adjacent fret 12.

In order to set the relief of the fingerboard 11 approximately to the degree originally intended by the manufacturer, the guitar strings 13 may be returned to proper pitch.

The flat tool 18 is provided on its flat surface 19, with a piece of flexible abrasive material such as a piece of coarse emery cloth 24. For the embodiment shown in FIG. 7 no abrasive material sheet is required as the surface **19*a* already has abrasive material such as diamond dust 26** thereon or formed therein.

The flat tool **18, 18*a* is inserted between the raised strings and the frets, the flats surface portions 19, 19*a* facing downward against the frets. It is advantageous to have the tool 18, 18*a* long enough to extend over three or four frets 12, as this allows the tool 18, 18*a* to be supported by the frets 12, without being so long as to bridge several frets 12 as a result of the relief or bowing curvature normally present in the fingerboard 11 when the guitar or other stringed instrument 17** is properly tuned.

The flat tool **18, 18*a* is then moved back and forth along the fingerboard 11 in a direction shown by the arrow A-B. This will grind or file down the fret 12 to a point below which the string 13 has worn it. The resulting fret will look like 12*c* of FIG. 1D, which is similar to the fret 12*a***, resulting from the first step of the prior art refinishing method.

Figure 1A:
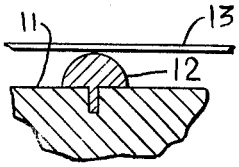
FIGS. 1A–1E are sectional views of a fret embedded in a fingerboard, showing a comparison of a new guitar fret shape with that attained both using a prior art method and by use and practice of the instant invention.
Figure 1B:
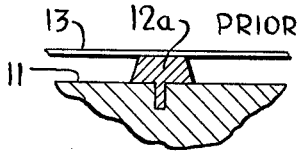
Figure 1C:
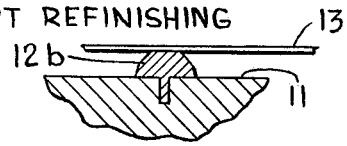
Figure 1D:
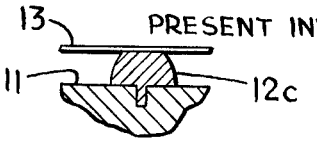

In order to shape the fret **12*c* into a form which approximates the new guitar fret shape 12 of FIG. 1A, the flat tool 18, 18*a* is removed and turned over so that the side 21, 21 a faces the frets 12. For the embodiment shown in the FIG. 5, a finer or less abrasive flexible sheet of abrasive material, such as a fine or very fine (500 to 600 grit) emery cloth 24*a* is used. The embodiment shown in FIG. 7 is provided with a fine grit 26*a* in the surface of the raised portion 22*a***.

Figure 1E:
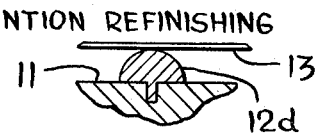

Moving the flat tool **18, 18*a* back and forth in the direction shown by arrow A-B in FIG. 8, will result in the fret 12*c* (FIG. 1D) being reshaped to the form shown in FIG. 1E of fret 12*d* as well as removing any burrs. The shape of the fret 12*d* shown in FIG. 1E which results from the raised portions 22, 22*a* riding over the frets 12, closely approximates the shape of the new guitar fret 12 shown in FIG. 1A, Because the fretted string instrument such as guitar 17 can be tuned before the frets are shaped with the flat tool 18, approximately the proper relief can be imparted to the fingerboard 11. This tuning of the instrument results in the frets 12 are not only being properly shaped, but also being properly aligned with respect to the rest of the instrument 17 when an instrument 17** is properly tuned for subsequent playing.

When using the apparatus of the instant invention in order to practice the method, a number of additional steps may be used for example to protect the instrument from being unnecessarily abraded. Thus, for the embodiment shown in FIG. 7, it is preferable not to have the abrasive material 26a extend over the point of the raised portion 22a. This will prevent the abrasive material from riding against the fingerboard; allowing only contact with the sides of the fret 12.

It may be desirable to mask off, with heavy paper or wide tape, the surfaces of the top of the instrument adjacent to the neck and/or any pickups or other surfaces that may be otherwise subject to scoring.

A preferred method for refinishing frets using the apparatus of the instant invention, which method contains precautions which are not required for refinishing the fret but result in protecting the instrument from unnecessary abrasion, is as follows:

STEP NO. 1

Loosen strings by turning each peg about five turns (or until strings are reasonably loose).

Insert fingerboard protective strip under the strings between the nut and first fret.

Place string lifting device in position flush to the nut and twist. Retune guitar to pitch.

STEP NO. 2

If necessary, mask off with heavy paper or wide tape the surfaces of the top of the instrument adjacent to the neck and/or any pickups of other surfaces that may be subject to scoring.

NOTE

If pick guard is higher than the top of the fingerboard, removal may be necessary.

STEP NO. 3

Place the flat tool and abrasive cloth such as "medium" emery cloth under the strings, making sure that the side with the raised portion is facing up and the abrasive side of the cloth meets with the tops of the frets. Fold edges of cloth over sides of the plate as shown. (See FIG. 5, element 24).

NOTE

To facilitate ease of placement of the flat tool and abrasive, line up both at a corner and slide into position.

CAUTION

Under no circumstances should the flat side of the tool without the raised portions facing up when being used with coarser abrasive cloths (reduces abrasion of the guitar fingerboard).

STEP NO. 4

Grasp plate and cloth firmly with one hand and starting at either end of the fingerboard move the hand up and down the full length applying an even downward pressure (CAUTION- do not press with undue force as a few light passes of the flat tool will remove sufficient material to correct the worst of pitted fret conditions.) making sure the full width of the frets are affected by the abrasive. This can be accomplished by tilting the plate slightly left and right.

NOTE

On classic or flat fingerboard guitars, tilting of the flat tool is not necessary *and should be avoided.*

STEP NO. 5

When the shiny low spots on the frets just disappear, (see FIG. 1) remove medium abrasive cloth and replace it with abrasive fine cloth, again making sure that the side with the raised portion of the tool is facing up. Make three of four passes the full length of the neck, with tilting, if necessary. Remove plate and cloth from under strings. Dust off fingerboard with suitable brush or cloth.

STEP NO. 6

Turn the flat tool over so that the side with the raised portions is now facing the fingerboard and together with very fine (500–600grit) abrasive cloth, begin peaking the frets by making ten to fifteen light full length passes with tilting if necessary.

STEP NO. 7

Final polishing of the frets can now be accomplished with extremely abrasive cloth (crocus cloth) and the side of the plate without the raised portion facing up.

Dust off filings and abrasive dust from the fingerboard using a brush or a cloth.

We wish it to be understood that we do not desire to be limited to the exact details of construction shown and described, for obvious modifications will occur to a person skilled in the art.

Having thus described the invention, what we claim as new and desire to be secured by Letters Patent is as follows:

1. An apparatus for refinishing a fret on the fingerboard of a fretted stringed instrument, comprising in combination a flat tool having two substantially parallel sides, a first side supporting abrasive material disposed substantially in a first plane, and a second side disposed substantially in a second plane with elongated portions raised above said second plane and supporting abrasive material on said raised elongated portions.

2. An apparatus as claimed in claim 1, wherein each of the elongated portions raised above the second plane comprises two substantially flat inclined surfaces intersecting each other at a line above the second plane.

3. An apparatus as claimed in claim 1, wherein said abrasive material comprises a flexible sheet of abrasive material.

4. An apparatus as claimed in claim 1, wherein said abrasive material comprises abrasive grit secured to the surface of the flat tool.

5. An apparatus, as claimed in claim 1, wherein the flat tool extends a distance to cover three frets but does not extend to a fourth fret.

6. An apparatus, as claimed in claim 1, wherein said flat tool is of such a size as to allow it to extend over at least two frets on the fretted stringed instrument.

7. An apparatus, as claimed in claim 1 in combination with a lifting device insertable to support the strings spaced away and above the frets a distance sufficient to permit insertion of the flat tool therebetween, to permit the strings to be tuned to pitch while in the supported portion.

8. An apparatus, as claimed in claim 1, in combination with a string lifting device comprising an elongated lifting portion sufficiently long to extend across the strings of the fretted string instrument, the cross-section of said lifting portion having two dimensions of unequal length; the smaller dimension being of a first predetermined size to permit the insertion of the lifting device between the fingerboard and the strings and the larger dimension being of a second predetermined size whereby rotation of the inserted tool will lift the strings away from the frets for a predetermined distance sufficient to permit insertion of said flat tool therebetween; the lifting device being operable to permit adjusting the tension on the strings to maintain the frets substantially in normal playing spacial relation to the rest of the instrument.

9. An apparatus, as claimed in claim 8, wherein the surface of the lifting portion which normally abuts against the strings when they are lifted define grooves operable to receive the strings.

10. An apparatus as claimed in claim 8, wherein said lifting device further comprises n elongated handle portion secured at an angle to said lifting portion to form a substantially L-shaped tool whereby the lifting portion may be easily rotated by moving the handle portion.

11. An apparatus, as claimed in claim 10, wherein:

the surface of said lifting portion which normally abuts against the strings when they are lifted, defines grooves operable to receive the strings;

the flat tool is of such size as to allow it to extend over at least two frets; and each of the elongated portions raised above the second plane comprises two substantially inclined flat surfaces intersecting each other at a line above the second plane.

12. A method for refinishing a series of frets mounted on the fingerboard of a fretted string instrument comprising the steps loosening the strings;

raising the strings away from the frets;

supporting the strings in the raised position; thereafter tuning the string instrument to approximate pitch; then inserting a tool sufficiently long to extend over more than two adjacent frets and having a first flat abrasive surface and a second surface with elongated raised abrasive portions, between the strings and the frets, with the first flat abrasive surface against the frets;

moving the tool along the fingerboard to file the surface of the frets to obtain a smooth flat surface;

subsequently removing the tool and reinserting it with the second surface against the frets; and thereafter moving the tool along the fingerboard to shape the frets.

* * * * *